US006309244B1

(12) United States Patent
Gundermann et al.

(10) Patent No.: US 6,309,244 B1
(45) Date of Patent: Oct. 30, 2001

(54) CONNECTOR ASSEMBLY AND POWER SHUNT CONTACT

(75) Inventors: James E. Gundermann, Warren; James E. McGeary, Harrisburg, both of PA (US)

(73) Assignees: Tyco Electronics Corporation, PA (US); Tyco Electronics Logistics AG, Steinach (CH)

( * ) Notice: Subject to any disclaimer, the term of this patent is extended or adjusted under 35 U.S.C. 154(b) by 0 days.

(21) Appl. No.: 09/351,592

(22) Filed: Jul. 12, 1999

Related U.S. Application Data

(60) Provisional application No. 60/094,620, filed on Jul. 30, 1998.

(51) Int. Cl.[7] ..... H01R 31/08
(52) U.S. Cl. ..... 439/507; 439/949
(58) Field of Search ..... 439/507, 509, 439/510, 540.1, 189, 638, 212, 949, 511, 76.2; 361/775

(56) References Cited

U.S. PATENT DOCUMENTS

| | | | | |
|---|---|---|---|---|
| 4,577,917 | * | 3/1986 | Nashimoto et al. | 439/638 |
| 4,659,158 | * | 4/1987 | Sakamoto et al. | 439/507 |
| 5,112,239 | * | 5/1992 | Yagi et al. | 439/189 |
| 5,207,591 | * | 5/1993 | Ozaki et al. | 439/212 |
| 5,281,165 | * | 1/1994 | McCleerey et al. | 439/510 |
| 5,908,322 | * | 6/1999 | Seki | 439/212 |

* cited by examiner

*Primary Examiner*—Tulsidas Patel
(74) *Attorney, Agent, or Firm*—Brinks Hofer Gilson & Lione

(57) ABSTRACT

A connector assembly is provided wherein a circuit is provided between two connector housings, such as two header connector housings, adapted to connect to two mating connector housings, such as two mating harness connector housings. Such circuit is provided by a power shunt contact that may be provided as a single piece of contact material which includes two contact lengths, which extend into respective header connector housings, and a bridging shunt segment extending therebetween.

7 Claims, 4 Drawing Sheets

CONNECTOR ASSEMBLY AND POWER SHUNT CONTACT

This application claims priority from Provisional Application No. 60/094,620, filed Jul. 30, 1998.

TECHNICAL FIELD

The present invention relates to a connector assembly, and more particularly to a connector assembly which includes at least two connector housings, each of which includes at least one contact, as for example a signal contact, and at least one other contact, as for example a power shunt contact, which extends into and between such two connector housings. The connector assembly is particularly useful as a header connector assembly.

A power shunt contact useful in such connector assembly is also disclosed.

BACKGROUND ART

It is known to mate male and female connector housings wherein contacts in adjacent male connector housings or adjacent female connector housings require shunting. For example, automobile wiring systems typically include wiring harnesses. Each harness contains many conductors that are electrically and mechanically connected to respective contacts contained in harness connector housings. The harness connector housings and the plurality of contacts contained therein are mated with respective header connector housings and the contacts contained therein. In such applications, it is often desirable to shunt contacts, as for example power contacts, in adjacent header connector housings. In order to accomplish this objective, the header connector housings typically include straight male power contacts one end of each of which mates with a harness female power contact and the other end of which is electrically and mechanically connected to a circuit board. Those power contacts of one header connector housing requiring shunting with respective power contacts of an adjacent header connector housing are shunted by providing respective traces therebetween on the circuit board between those ends of the power contacts connected to the circuit board. In particular, in order to provide a circuit between two header connector housings it is necessary to provide two separate power contacts in adjacent header connector housings one end of each of which is soldered to the same circuit trace on a circuit board. Shunting in this manner requires multiple power contacts and electrical and mechanical connection to the circuit board effected by a soldering procedure regardless of whether it is desired to connect the power contacts to the circuit board.

DISCLOSURE OF THE INVENTION

It is an object of the present invention to provide an improved connector assembly and improved shunt contact.

Another object of the present invention is to obviate the disadvantages of the prior art.

A further object of the present invention is to provide a connector assembly, and a single shunt contact, whereby a circuit may be provided between two connector housings.

Yet another object of the present invention is to provide a connector assembly, and a shunt contact, whereby contact lengths may be shunted between two connector housings without the need for connecting the lengths to a circuit board.

Another object of the present invention is to provide a connector assembly, and a shunt contact, whereby contact lengths may be shunted between two connector housings without the need for connecting the lengths to a circuit board but wherein the shunted contact may be electrically and mechanically connected to the circuit board if desired.

A further object of the present invention is to provide a connector assembly, which comprises at least two header connector housings, which achieve all of the foregoing objectives.

The present invention achieves these and other objects by providing a shunt contact and a connector assembly which comprises such a shunt contact. The connector assembly comprises a first connector housing, a second connector housing and at least one shunted contact extending therebetween. The first connector housing is structured and arranged to be slidably engagable with a first mating connector housing. The first connector housing comprises a first cavity and extends in the direction of a longitudinal axis from a first front end to an opposite first rear end. The first connector housing also includes at least one first contact which extends in such direction and comprises a first segment which extends into the first cavity and a second segment which extends out of the first cavity at the first rear end. The second connector housing is structured and arranged to be slidably engagable with a second mating connector housing. The second connector housing comprises a second cavity and extends in such direction from a second front end to an opposite second rear end. The second connector housing also includes at least one second contact which extends in such direction and comprises a third segment which extends into the second cavity and a fourth segment which extends out of the second cavity at the second rear end. At least one shunt contact is provided which comprises a third contact which extends in such direction and into the first cavity from a first end portion to a first distal end, and a fourth contact which extends in such direction and into the second cavity from a second end portion to a second distal end. A bridging shunt segment is provided which extends from the first end portion to the second end portion.

BRIEF DESCRIPTION OF THE DRAWINGS

This invention may be clearly understood by reference to the attached drawings in which like reference numerals designate like parts and in which.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

The connector assembly of the present invention includes at least one first connector housing and at least one second connector housing each of which comprises at least one contact, as for example at least one signal contact. The connector assembly also comprises at least one shunt contact, as for example at least one power shunt contact, extending within and between the first and second connector housings. Other power contacts which are not shunted may also be provided in each connector housing. The signal contacts and the power contacts which are not shunted are adapted to be electrically and mechanically connected to a circuit such as may be provided by a circuit board. The connector housings of the connector assembly of the present invention are slidably engagable with mating connector housings. Without limitation, the connector assembly of the present invention may be a header connector assembly of the type used in automobile wiring systems, such header connector assembly comprising at least two header connector housings. In such an automobile wiring system, various bundles of wires forming conventional wiring harnesses will be electrically and mechanically connected to respective contacts housed in respective harness connector housings. Each harness connector housing and the contacts therein is adapted for connection to a respective header connector housing, and contacts therein, of a header connector assembly.

Figure 1:
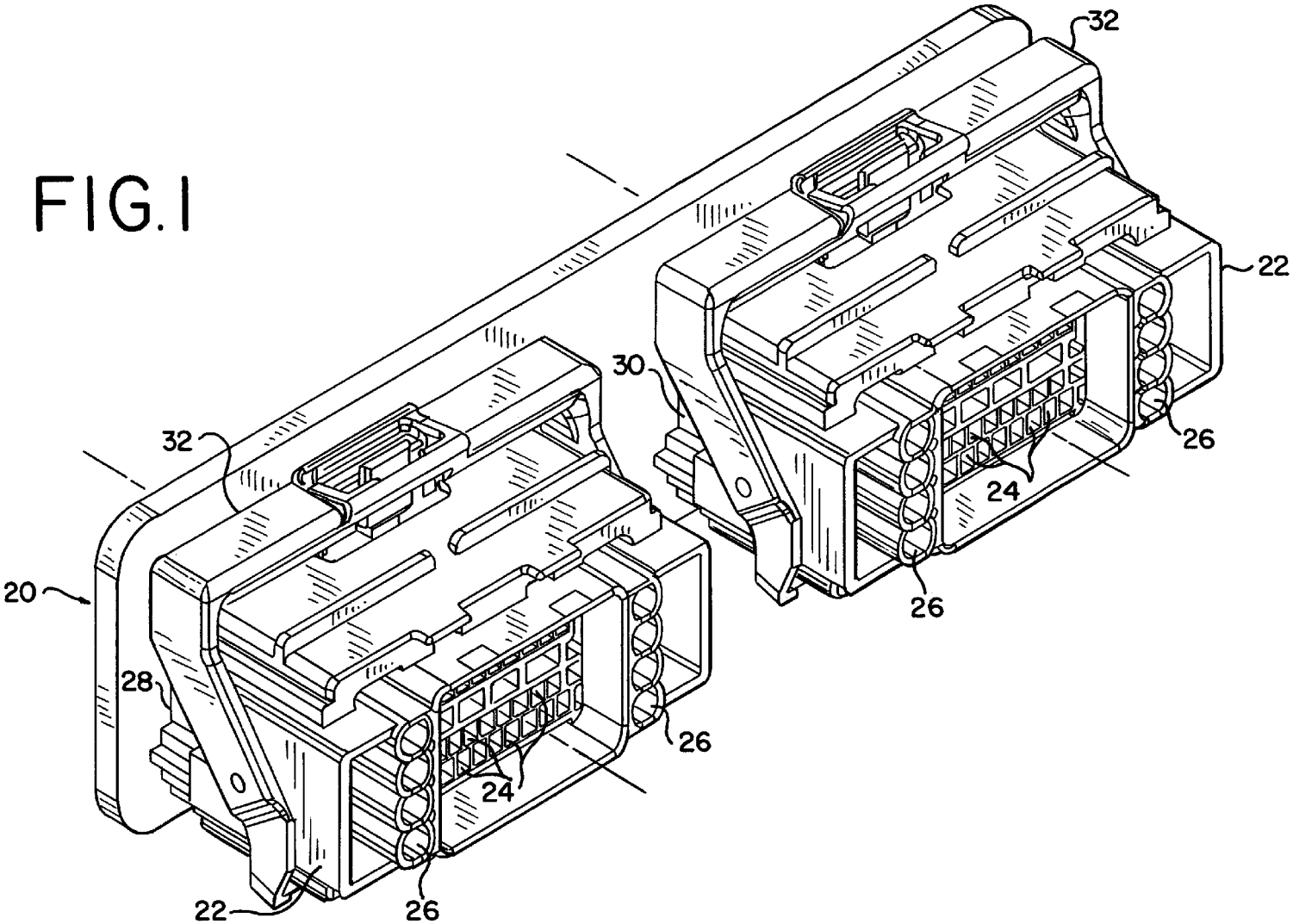
FIG. 1 is a perspective view of one embodiment of the connector assembly of the present invention connected to two mating connector housings.

FIG. 1 illustrates one embodiment of a header connector assembly 20 of the present invention slidably engaged with two mating harness connector housings 22. In particular, two harness connector housings 22 are provided each of which includes a plurality of openings 24 and 26 which are structured and arranged to contain female signal contacts and female power contacts, respectively (not shown), which are electrically and mechanically connected to respective wires of a wiring harness in a conventional manner. The header connector assembly 20 of the present invention includes two connector housings 28 and 30 each of which include a plurality of openings which contain respective male signal contacts and male power contacts which mate with respective female signal and power contacts contained within a respective harness connector housing 22 when the harness and header connector housings are mated with each other as illustrated in FIG. 1. In one embodiment, the harness connector housing 22, and the header connector housings 28 and 30 may each contain thirty eight contacts on 0.64 mm centers. The friction generated when attempting to connect or disconnect such male and female contacts is sufficiently high to render such task very difficult. To facilitate connection or disconnection, a lever 32 is supported on each harness connector housing 22 for urging each harness connector housing 22 and respective header connector housings 28 and 30 towards and away from each. The connector assembly 20 is particularly suited to connectors used in a sealed system.

Figure 2:
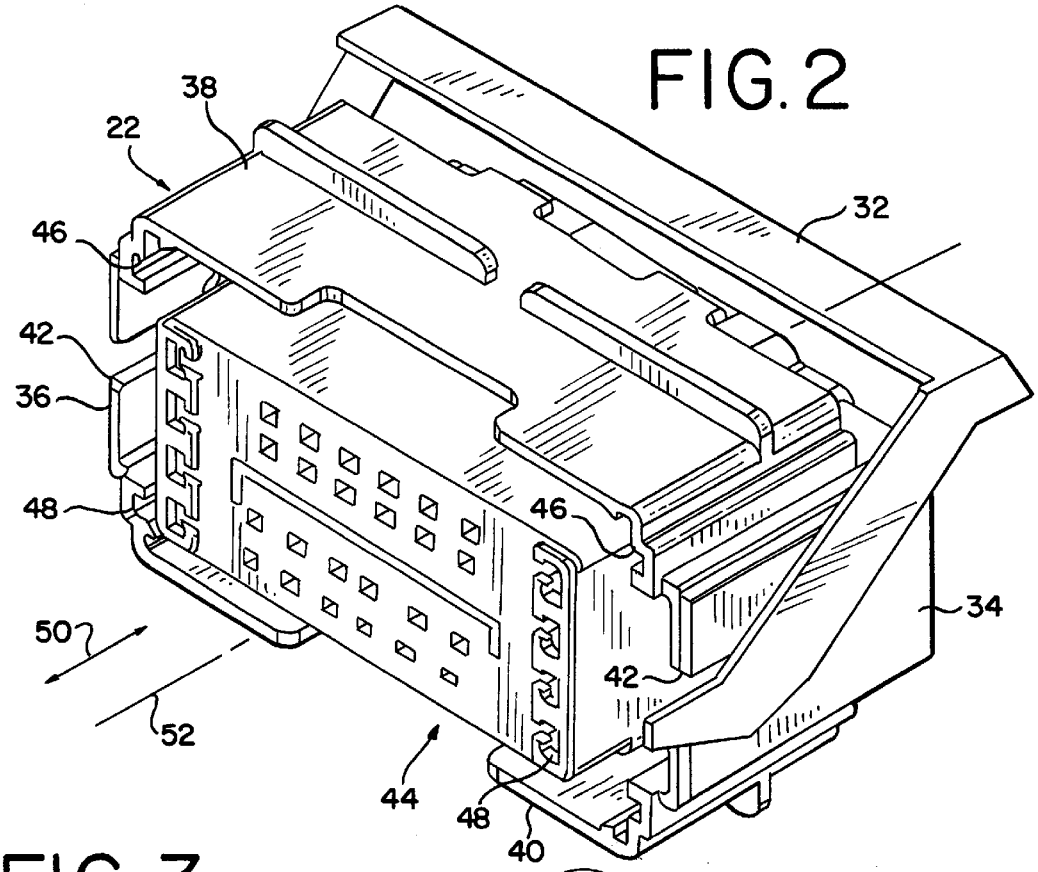
FIG. 2 is a perspective view of a mating connector housing of FIG. 1.

The details of the harness connector housing 22 are illustrated in FIG. 2. Harness connector housing 22 includes opposing sidewalls 34 and 36 and opposing top and bottom walls 38 and 40, respectively. Although not necessary, the harness connector housing 22 is symmetrical and to this end, sidewall 34 is identical to sidewall 36, top wall 38 is identical to bottom wall 40 and the internal features of the housing are symmetrical throughout. As such, the housing 22 may be used as illustrated in FIG. 2 or may be inverted such that wall 38 serves as the bottom wall and wall 40 serves as the top wall.

Sidewalls 34 and 36 each comprise an aperture 42 extending therethrough. Lever 32 is mounted to the connector 22 at apertures 42. The header connector housings 28 and 30 are inserted into respective harness connector housings 22 at the end 44 of the harness connector housings. To facilitate such insertion, the harness connector housing 22 comprises elongated upper grooves 46 and elongated lower grooves 48 which extend within each harness connector housing in the direction 50 of a longitudinal axis 52 of each harness connector housing.

Figure 3:
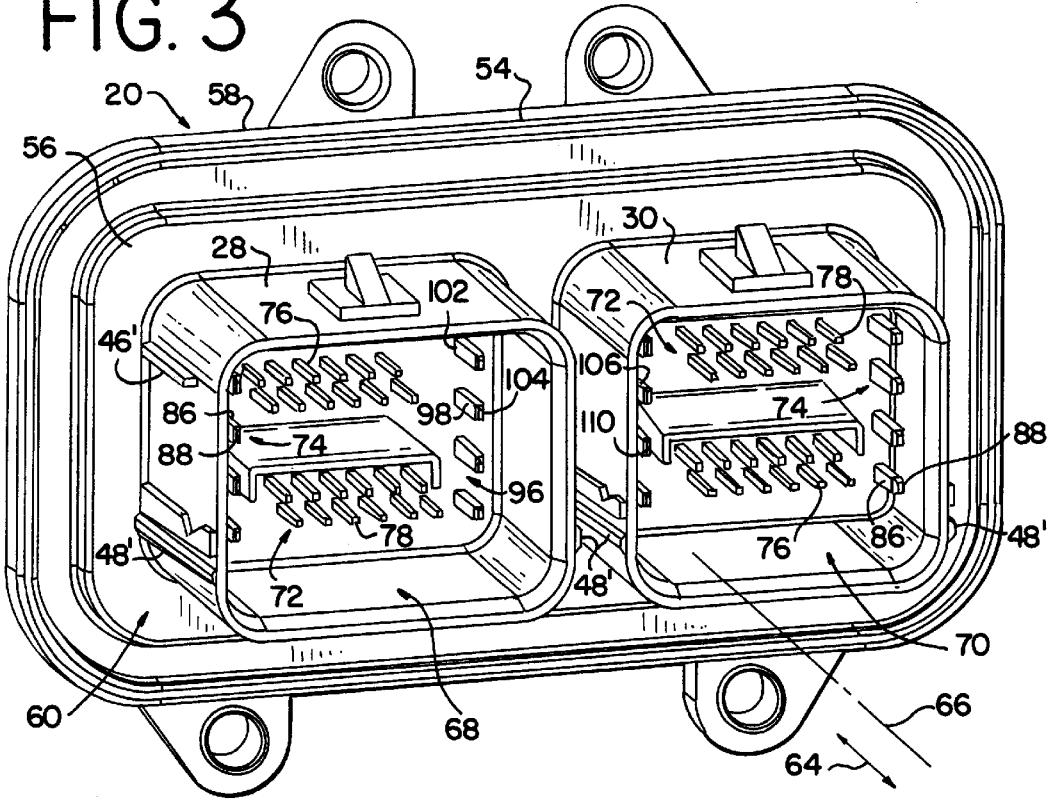
FIG. 3 is a front perspective view of the connector assembly of the present invention illustrated in FIG. 1.
Figure 5:
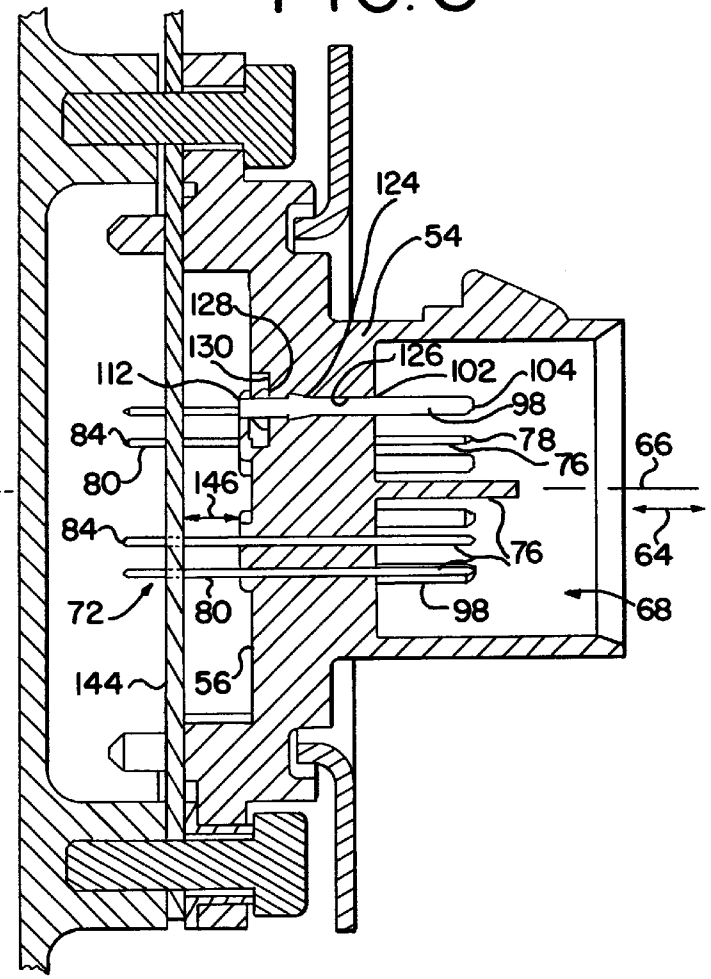
FIG. 5 is a cross section of a connector assembly of the present invention of the type illustrated in FIG. 1 connected to a printed circuit board.
Figure 4:
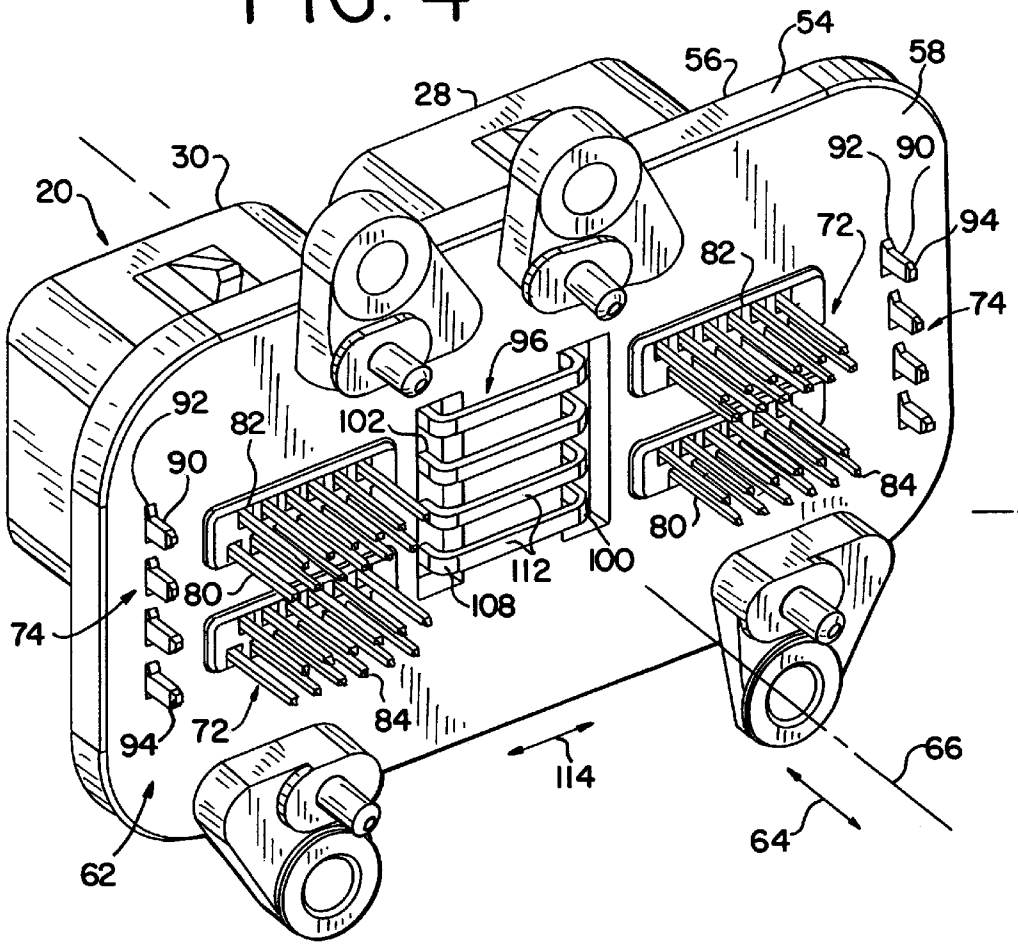
FIG. 4 is a rear perspective view of the connector assembly illustrated in FIG. 3.

FIGS. 3 to 5 illustrate the details of the header connector assembly 20. Header connector assembly 20 comprises a base 54 that comprises a first surface 56 and an opposite second surface 58. The surface 56 faces towards the front 60 of the connector assembly 20, and the surface 58 faces towards the rear 62. The connector housings 28 and 30 each extend in the direction 64 of a longitudinal axis 66 from a rear end adjacent surface 56 to an opposite front end adjacent an opening to respective cavities 68 and 70. Elongated upper ribs 46' and elongated lower ribs 48' extend in direction 64 and are structured and arranged to mate with grooves 46 and 48, respectively, of harness connectors 22 to facilitate mating the harness connectors 22 with respective header connectors 28, 30. Cavities 68 and 70 each comprises a plurality of signal contacts 72 and a plurality of power contacts 74. Contacts 72 and 74 extend in the direction 64 of axis 66. Each signal contact 72 includes a segment 76 which extends into a respective cavity 68 and 70 to a distal end 78 and a segment 80 which extends through an aperture 82 in the base 54 and away from a respective cavity 68 and 70 and the surface 58 to a distal end 84. Each contact 72 may be force fit or otherwise secured within an aperture 82 in a conventional manner.

With reference to FIGS. 3 and 4, each power contact 74 includes a segment 86 which extends into a respective cavity 68 and 70 to a distal end 88 and a segment 90 which extends through an aperture 92 in the base 54 and away from a respective cavity 68 and 70 and surface 58 to a distal end 94.

Figure 6:
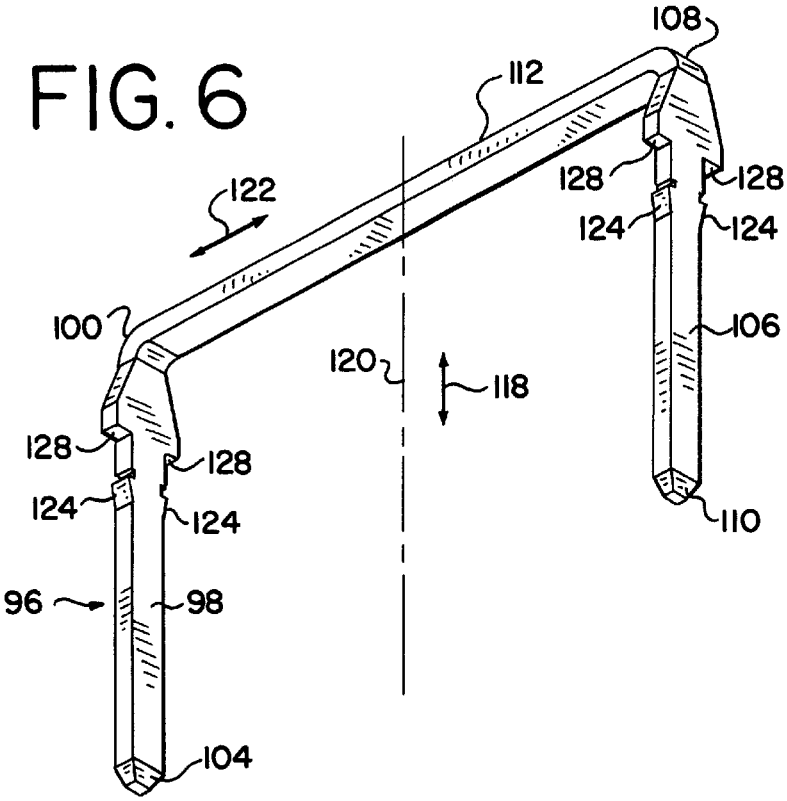
FIG. 6 is a perspective view of one embodiment of the shunt contact of the present invention.

With reference to FIGS. 3 to 6, the connector assembly 20 comprises a plurality of power shunt contacts 96, each of which extends within and between cavities 68 and 70. For example, cavity 68 comprises a plurality of power contacts 98 each of which extend from an end portion 100 through an aperture 102 in the base 54 to a distal end 104. Similarly, cavity 70 comprises a plurality of power contacts 106, each of which extends from an end portion 108 through another aperture 102 in the base 54 to a distal end 110. With reference to FIGS. 4 and 6, a bridging shunt segment 112 extends from the end portion 100 to the end portion 108. In the connector assembly illustrated in FIGS. 1 to 5, the bridging contact segment 112 extends in a direction 114 that is transverse to the longitudinal axis 66. Each pair of power contacts 98, 106 joined by a bridging shunt segment 112 form of power shunt contact 96.

In the embodiment illustrated in FIGS. 1 to 6, each power shunt contact 96 comprises a single piece of contact material. For example, FIG. 6 illustrates the details of the power shunt contact 96. Power shunt contact 96 comprises a pair of power contacts 98, 106 joined by bridging shunt segment 112, formed from a single piece of contact material. The contacts 98 and 106 extend in the direction 118 of a longitudinal axis 120, and the bridging shunt segment 112 extends in direction 122 which is transverse to axis 120.

The power shunt contact of the present invention may comprise at least one protrusion structured and arranged to be disposed within an aperture of the connector housing base, and such protrusion may be further structured and arranged for engagement with a surface of such base aperture when the power shunt contact has been attached to the base in an assembled mode. For example, the contacts 98 and 106 of the power shunt contact member illustrated in FIG. 6, each comprise two protrusions 124 in the form of respective barbs which engage a surface 126, of the aperture 102 of base 54 when the power shunt contact has been attached to the base in an assembled mode as illustrated in FIG. 5. The protrusions 124 serve to perfect the attachment of the power shunt contact to the base 54.

The contacts of the power shunt contact of the present invention may each comprise at least one abutment surface structured and arranged for engagement with an outer surface of the base of the connector housing when the power shunt contact member has been attached to the base in an assembled mode. For example, the contacts 98 and 106 of the power shunt contact 96 illustrated in FIG. 6 each comprise two abutment surfaces 128 which engage surface 130 of base 54 when the power shunt contact has been attached to the base in an assembled mode as illustrated in FIG. 5. The engagement of the surfaces 128 of the contacts 98, 106 with the base surface 130 provides a manner by which an assembler of the connector housing of the present invention will know when the power contacts have been fully inserted into the respective cavities 68 and 70.

Figure 7:
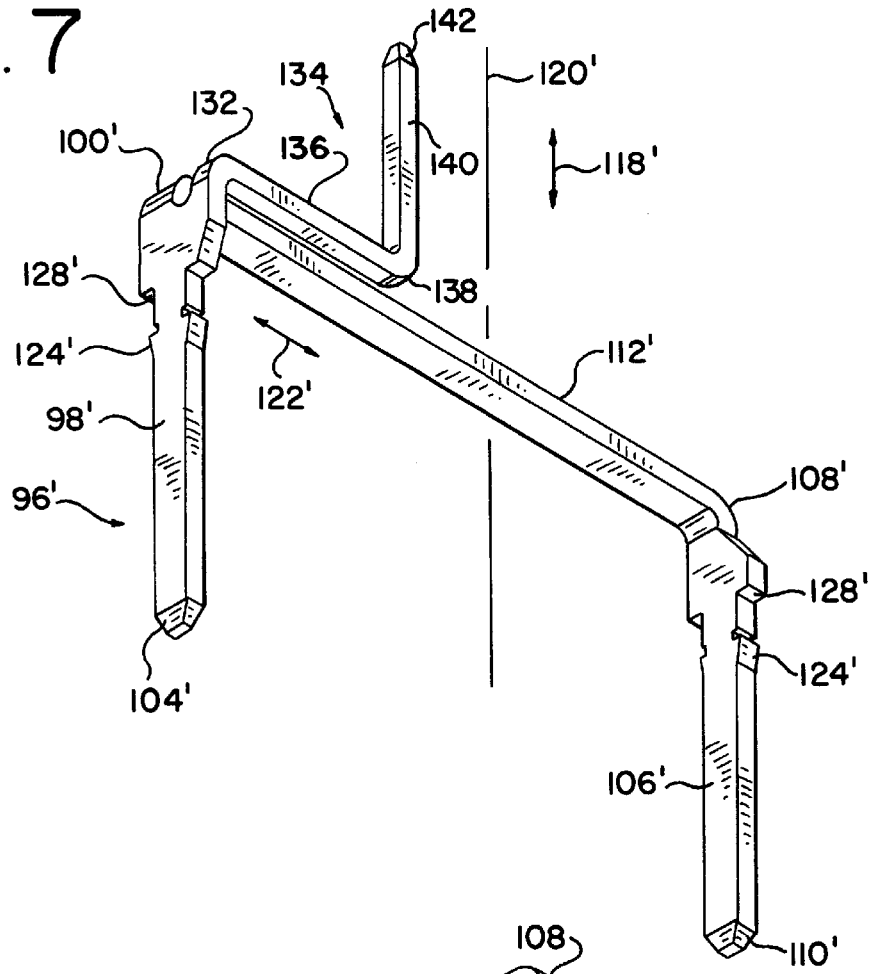
FIG. 7 is a perspective view of another embodiment of the shunt contact of the present invention.

FIG. 7 illustrates an alternative embodiment of a power shunt contact of the present invention. The embodiment illustrated in FIG. 7 is substantially the same as the embodiment illustrated in FIG. 6 and like elements have the same reference numerals primed. The embodiment illustrated in FIG. 7 differs from that of FIG. 6 in that the power shunt contact 96 of FIG. 6 is generally U-shaped and the power shunt contact 96' of FIG. 7 is generally Y-shaped. In particular, in considering the power shunt contact of FIG. 7, the power contact 98' extends from the distal 104' to an end portion 100' and to another end portion 132. To this end, the power contact 98' is bifurcated at the end which comprises end portions 100' and 132. In addition, a contact segment is provided which extends from the end portion 132 and includes at least a length which extends in the direction 118' of axis 120' to a distal end. For example, in the embodiment illustrated in FIG. 7, a contact segment 134 is provided which comprises length 136 which extends in direction 122', which is transverse to axis 120', from the end portion 132 to a junction 138, and another length 140 which extends in the direction 118' of axis 120' from the junction 138 to a distal end 142. The length 140 provides a manner in which the power shunt contact 96' may be connected to a circuit board. The power shunt contact 96' includes a strain relief feature which reduces the likelihood that the length 140 will become bent when connected to the circuit board. In particular, the semi-circular bend at end portion 132 provides the length 140 with a degree of resilience in direction 118' and thereby allows the length 140 some give during connection to the circuit board.

Fabrication of the power shunt contact 96, 96' may be accomplished using conventional procedures. For example, the power shunt contact 96, 96' may be provided as a single piece of contact material by stamping the contact in its entirety from a metal sheet and then rolling and/or bending as required to form the desired configuration. For example, in the embodiments illustrated in FIGS. 6 and 7, the power shunt contacts have been stamped and bent from strip metal material so as to be provided with a rectangular cross-sectional configuration. In this manner, the semi-circular bends at end portions 100, 100'; 108, 108'; 132 and 138 may be readily formed by bending across the thin material thickness as illustrated in FIGS. 6 and 7. Alternatively, power contact 96, 96' may comprise individual components which are welded or otherwise connected together to form the desired configuration. For example, power contacts 98, 106 and bridging shunt segment 112 may be individually stamped or otherwise formed and then welded together to form a power shunt contact similar in configuration to power shunt contact 96 illustrated in FIG. 6. Regardless of whether contact 96, 96' is a single piece of metal or multiple pieces welded together, a circuit is provided between header connector housings 28 and 30 using a single contact member without the need for connecting the contact to a circuit board. For example, FIG. 5 illustrates signal contacts 72 electrically and mechanically connected to traces on a circuit board 144. Power contacts 74 (not shown) may be connected to circuit board 144 in a similar manner. However, the power shunt contacts 96 do not engage the circuit board 144. In particular, the bridging shunt segments 112 are spaced from the circuit board 144 a distance 146 and extend transverse to axis 66 (into the paper in FIG. 5), each bridging shunt segment extending in such transverse direction adjacent the surface 56 of the base 54. The bridging shunt segment 112' of FIG. 7 is oriented in a manner that is identical to the orientation of bridging shunt segment 112. However, when the embodiment of FIG. 7 is used, the length 140 of contact segment 134 may be electrically and mechanically connected to a trace on the circuit board 144. Regardless of whether the contacts of FIGS. 6 or 7 are used, the connector assembly of the present invention allows for compact integration of connector contacts which may be sealed to protect the connector assembly from environmental considerations using individual wire seals and a grommet seal. In such connector assembly, the placement of an equal number of power contacts on each side of each connector housing allows shunting in either direction and equally distributes the insertion force when the connector housings 28 and 30 are mated with a respective mating connector housing 22.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

We claim:

1. A shunt contact, comprising:

a first contact extending in a direction of a longitudinal axis from a first distal end to a first end portion;

a second contact extending in said direction from a second distal end to a second end portion;

a bridging shunt segment extending from said first end portion to said second end portion;

a third contact extending from proximate the first end portion, the third contact having a contact length which extends to a third distal end, the third distal end extending in the direction opposite the direction of the first distal end;

wherein the third contact having a connecting length which extends from the first end portion to the contact length, the connecting length extends in a direction which is essentially perpendicular to the contact length and essentially parallel to the bridging shunt segment; and a connector base having at least one aperture on a top surface thereof, wherein the first and second contacts comprise at least one protrusion structured and arranged to be disposed within said aperture of said connector base, in an assembled mode.

2. The shunt contact as recited in claim 1 wherein the first end portion is bifurcated to allow the bridging shunt segment and the third contact to extend therefrom.

3. The shunt contact as recited in claim 1 wherein a strain relief is provided in the third contact, whereby as the third contact is engaged with a mating member, the strain relief will resiliently deform to allow the contact length to be properly positioned relative to the mating member.

4. The shunt contact as recited in claim 3 wherein the strain relief is a connection length with a bend provided at both ends thereof which extends between the first end portion and the contact length.

5. The shunt contact as recited in claim 1 wherein the first contact, second contact, third contact, and bridging shunt segment comprise a single piece of contact material.

6. The shunt contact as recited in claim 1 wherein the bridging shunt segment and the connecting length are transverse to the longitudinal axis.

7. The shunt contact as recited in claims 1 wherein the protrusion is structured and arranged for engagement with a surface of said aperture, in an assembled mode, and at least one abatement surface structured and arranged for engagement with an outer surface of said connector base, in said assembled mode.

* * * * *

UNITED STATES PATENT AND TRADEMARK OFFICE

CERTIFICATE OF CORRECTION

PATENT NO. : 6,309,244 B1
DATED : October 30, 2001
INVENTOR(S) : James E. Gundermann et al.

It is certified that error appears in the above-identified patent and that said Letters Patent is hereby corrected as shown below:

Column 8,
Line 1, delete "claims 1" and substitute -- claim 1 -- in its place.

Signed and Sealed this

Third Day of December, 2002

JAMES E. ROGAN
*Director of the United States Patent and Trademark Office*